US005143034A

United States Patent [19]

Hirose

[11] Patent Number: 5,143,034

[45] Date of Patent: Sep. 1, 1992

[54] LUBRICATION SYSTEM FOR V-TYPE OVERHEAD CAMSHAFT ENGINE

[75] Inventor: Ichiro Hirose, Hiroshima, Japan

[73] Assignee: Mazda Motor Corporation, Hiroshima, Japan

[21] Appl. No.: 676,574

[22] Filed: Mar. 28, 1991

[30] Foreign Application Priority Data

Mar. 29, 1990 [JP] Japan ..... 2-33144[U]
May 24, 1990 [JP] Japan ..... 2-54785[U]

[51] Int. Cl.[5] ..... F01M 11/02

[52] U.S. Cl. ..... 123/196 R; 123/90.33; 123/90.34; 123/90.18; 184/6.5

[58] Field of Search ..... 123/196 R, 90.33, 90.34, 123/90.16, 90.18, 90.17; 184/6.5

[56] References Cited

U.S. PATENT DOCUMENTS 4,709,667 12/1987 Ichihara ..... 123/90.34
4,852,534 8/1989 Amaval ..... 123/196 R
4,938,188 7/1990 Seki et al. ..... 123/90.16
4,942,855 7/1990 Moto ..... 123/90.33
4,957,079 9/1990 Nakatani et al. ..... 184/6.5
5,003,937 4/1991 Matsumoto et al. ..... 123/90.16
5,027,762 7/1991 Tokuyama ..... 123/90.34
5,058,539 10/1991 Saito et al. ..... 123/90.17

FOREIGN PATENT DOCUMENTS 61-261612 11/1986 Japan .
62-57711 4/1987 Japan .

*Primary Examiner*—E. Rollins Cross
*Assistant Examiner*—Erick Solis
*Attorney, Agent, or Firm*—Fleit, Jacobson, Cohn, Price, Holman & Stern

[57] ABSTRACT

A lubrication system for a double overhead camshaft engine has a lubrication oil passage for applying regulated pressurized oil to each of intake and exhaust overhead camshafts for lubrication; oil passages branching off from the lubrication oil passage for applying pressurized oil to hydraulic valve lash adjusters and a variable valve timing mechanism, respectively, for hydraulic operation. The oil passage for the variable valve timing mechanism is formed in one of the intake and exhaust overhead camshafts to which the variable valve timing mechanism is installed and is provided with a control valve for opening the oil passage so as to actuate the hydraulic variable valve timing mechanism with pressurized oil when the engine operates at lower engine speeds.

9 Claims, 7 Drawing Sheets

LUBRICATION SYSTEM FOR V-TYPE OVERHEAD CAMSHAFT ENGINE

BACKGROUND OF THE INVENTION

1. Field of the Invention

This invention relates to a lubrication system for a V-type overhead camshaft engine, and, more particularly, to a lubrication system comprising various oil passages formed in a cylinder head of a V-type overhead camshaft engine which is equipped with a hydraulic valve lash adjuster for each valve and a variable valve timing mechanism.

2. Description of Related Art

A double overhead camshaft engine has a pair of overhead camshafts, namely an intake camshaft and an exhaust camshaft, each equipped with cams, and which are coupled to each other by a drive camshaft gear and a driven camshaft gear in mesh with each other. One of the camshafts is equipped with a camshaft sprocket, or a camshaft pulley, which is connected or coupled to the crankshaft by a timing belt forming a drive connection between the engine output shaft and the camshaft pulley.

Coupling the overhead camshafts with the drive and driven camshaft gears allows the overhead camshafts to be located close to each other, so that the intake and exhaust valves can be arranged at a small acute angle relative to each other with respect to a combustion chamber. This results in a small size of engine body and a simple combustion chamber structure with increased fuel combustion efficiency.

Typically, an engine valve drive mechanism or system is equipped with a variable valve timing mechanism for changing the timing at which the intake and exhaust valves are opened and closed by the camshafts. The variable valve timing mechanism cooperates with a camshaft to change the rotational phase of the camshaft so as to retard or advance the valve timing of one of the intake and exhaust valves relative to the other according to engine operating conditions. Such an engine valve drive mechanism is known, for example, from Japanese Unexamined Utility Model Publication No. 62-57711.

The variable valve mechanism described in the above publication is one which is actuated by a hydraulic control system and controlled by an electromagnetic actuator disposed in an oil outflow portion at the end of the camshaft equipped with the variable valve timing mechanism.

It is also known to provide a valve lash adjuster, such as a hydraulic valve lash adjuster (HLA), to perform automatic adjustment of valve clearance. Oil is supplied to the valve lash adjuster from an oil passage in the cylinder head for lubricating camshaft journal bearings.

In order for the double overhead camshaft engine, to supply working oil to the variable valve timing mechanism and the valve lash adjuster as well as to bearings for the intake and exhaust overhead camshafts, the engine body must be provided with oil passages. However, in a double overhead camshaft engine, which is compact in size and has a narrow space between the intake and exhaust overhead camshafts, it is difficult to provide a plurality of oil passages without interfering with the valves and spark plugs. Further, providing a number of oil passages is not favorable either for the valve lash adjusters which require high pressure oil to work with accuracy and high efficiency, or for the engine body which requires a high rigidity of structure.

In an engine equipped with a variable valve timing mechanism and a valve lash adjuster as described above, if an oil supplying system to both the variable valve timing mechanism and the valve lash adjuster is provided with an orifice, for regulating the quantity and pressure of oil supplied to the cylinder head for the purpose of maintaining a necessary oil pressure to the cylinder head and reducing an unnecessary flow of oil in the cylinder head, disposed between the cylinder block and cylinder head, it is difficult to maintain both the variable valve timing mechanism and the valve lash adjuster under well controlled operation.

More particularly, for the purpose of maintaining lubrication oil at a necessary pressure in the cylinder block and balancing the quantities of oil delivered into the cylinder block and the cylinder head, the oil available for flow into the cylinder head is somewhat restricted. Also, when the working pressure of oil is low due to an insufficient supply of oil to the valve lash adjuster while the engine operates at lower speeds, such as during idling, and generates lower oil pressure, while the oil temperature is high, or when starting the engine after a long period left not operated, etc., it takes time to discharge air within the valve lash adjuster, leading to the generation of an anomalous sound.

To prevent the generation of such anomalous sound, the air within the valve lash adjuster may be forced out in a short time by introducing oil at high pressure into the valve lash adjuster. However, the high pressure oil is their also supplied, unnecessarily, to the camshaft bearing means, which do not inherently need high pressure lubrication oil, so as to cause an increase of end flow oil, and accordingly, a large capacity of oil pump is necessary.

SUMMARY OF THE INVENTION

The present invention has a primary object to provide a lubrication system for a double overhead camshaft engine with an hydraulic system which has a simple arrangement of oil passages.

It is another object of the present invention to provide a lubrication system for a double overhead camshaft engine with a hydraulic system which can supply working oil to a variable valve timing mechanism and to valve lash adjusters with high stability.

It is another object of the present invention to provide a lubrication system for a double overhead camshaft engine with a hydraulic system which allows the cylinder head to have a high rigidity of structure.

The invention provides an engine lubrication system for a cylinder head of a double overhead camshaft engine equipped with a hydraulic variable valve timing mechanism, operationally coupled to either one of an intake and exhaust overhead camshaft, the camshafts being arranged in parallel to each other with respect to a crankshaft of the engine and being supported, respectively, by bearing means for rotation, and a hydraulic valve lash adjuster installed in the cylinder head for each valve. A lubrication oil passage with pressure regulating means is formed in the cylinder head for supplying pressurized oil to the bearing means for lubrication. A first oil supply passage, for supplying the pressurized oil to and actuating and lubricating the hydraulic valve lash adjusters, is formed in the cylinder head and branches off from the lubrication oil passage before the pressure regulating means. The pressure regulating means causes a decrease in pressure of the pressurized oil in the lubrication oil passage. A second oil supply passage, for supplying the pressurized oil to the hydraulic variable valve timing mechanism, is further formed in the cylinder head and extends from the first oil supply passage for supplying the pressurized oil to the hydraulic variable valve timing mechanism. The second oil supply passage is provided with control valve means for selectively opening the second oil supply passage so as to actuate the hydraulic variable valve timing mechanism with the pressurized oil. The control valve means closes the second oil supply passage when the engine operates at lower speeds.

The one overhead camshaft is formed with an oil passage along its entire axial length for interconnecting the second oil supply passage and the hydraulic variable valve timing mechanism.

The lubrication oil passage and the first oil supply passage extend along substantially the entire length of the cylinder head and are arranged vertically in parallel with each other between the intake and exhaust overhead camshafts.

The lubrication system supplies low pressure oil through the lubrication oil passage with pressure regulating means, such as an orifice, from an oil pump and reduces the quantity of end flow oil. On the other hand, the system supplies high pressure oil to both the variable valve timing mechanism and the valve lash adjusters even with a small capacity of oil pump. The system remedies the generation of anomalous sound by the discharge of air in the hydraulic valve lash adjusters at an early stage of operation. On the other hand, the system in which the control valve operates to close the second oil supply passage when the engine operates at lower speeds can supply sufficient oil to the hydraulic valve lash adjuster for which high oil pressure is necessary.

BRIEF DESCRIPTION OF THE DRAWINGS

The above and other objects and features of the present invention will be apparent from the following description of a preferred embodiment thereof when considered in conjunction with the appended drawings, in which similar reference numbers have been used to designate the same or similar elements throughout the drawings, and wherein.

DETAILED DESCRIPTION OF THE PREFERRED EMBODIMENT

Figure 1:
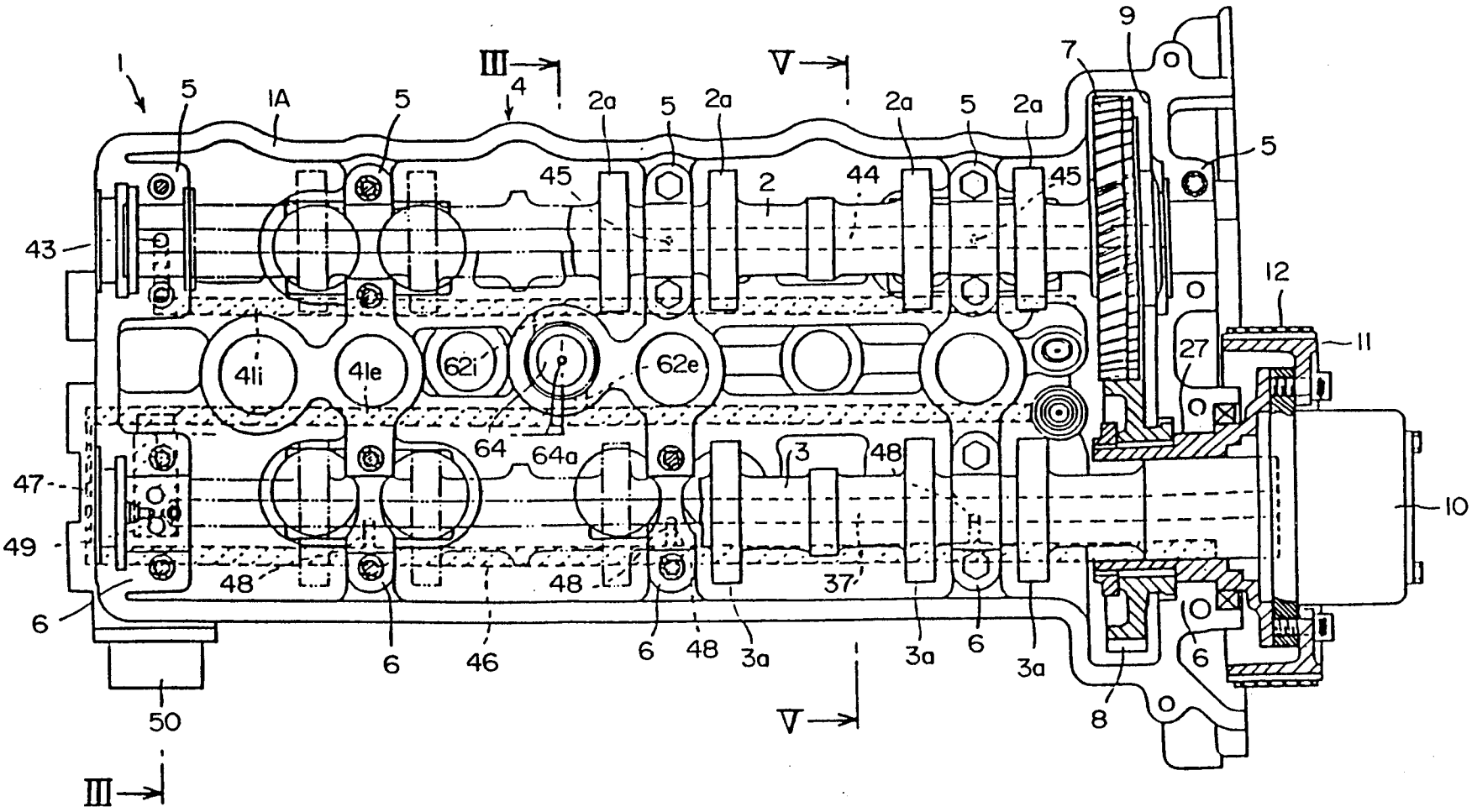
FIG. 1 is a plan view of a cylinder head of a double overhead camshaft engine having a lubrication system in accordance with a preferred embodiment of the present invention.
Figure 2:
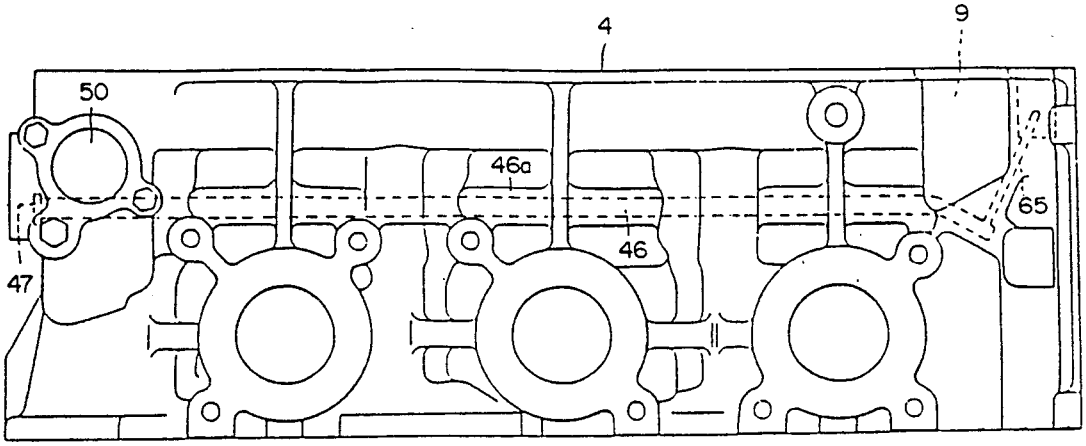
FIG. 2 is a side view of the cylinder head shown in FIG. 1.

Referring now to the drawings in detail, in particularly, to FIGS. 1 to 6, a V-6, overhead camshaft, internal combustion engine 1 with a lubrication system in accordance with a preferred embodiment of the present invention is shown, comprising a cylinder head 4 with two banks of cylinders (one of which is shown and is generally designated by a number 1A). The cylinder bank 1A is provided with two intake valves and two exhaust valves for each cylinder. The cylinder bank IA is formed with cam journal bearings 5 and 6 formed in the top portion thereof which support intake and exhaust overhead camshafts 2 and 3, respectively. The intake and exhaust camshafts 2 and 3, having intake cams **2*a* and exhaust cams 3*a*, one for each valve, drive intake valves 17 and exhaust valves 18, respectively, to open and close intake ports 15 and exhaust ports 16** at a predetermined timing.

The intake and exhaust camshafts 2 and 3 are provided with camshaft gears 7 and 8 at their ends, respectively, which are received in a gear chamber 9 formed in the top portion of the cylinder head 4. The camshaft gears 7 and 8 are in mesh with each other so as to turn the intake and exhaust camshafts 2 and 3 in opposite directions.

The end portion of the exhaust camshaft 3 where the camshaft gear 8 is provided projects outward the cylinder head 4 and is provided with a variable valve timing mechanism 10 with a drive power transmission ring, such as a drive sprocket, or pulley 11 which will be described in detail later. The drive pulley 11 is connected or coupled to a crankshaft pulley (not shown) by a timing belt 12 which transmits drive from the engine output shaft to the drive pulley 11.

Each cylinder is provided with an intake port 15 whose opening extends toward a V-shaped space formed between the two cylinder banks. Further, each cylinder is provided with an exhaust port 16 whose opening extends to the side of the cylinder bank 1A remote from the V-shaped space. A combustion chamber 14 is formed at the top of a cylinder bore **14*a* of each cylinder. The intake ports and the exhaust ports 16 open into the combustion chamber 14, and are opened and closed at a predetermined timing by the intake and exhaust valves 17 and 18**, respectively.

Figure 5:
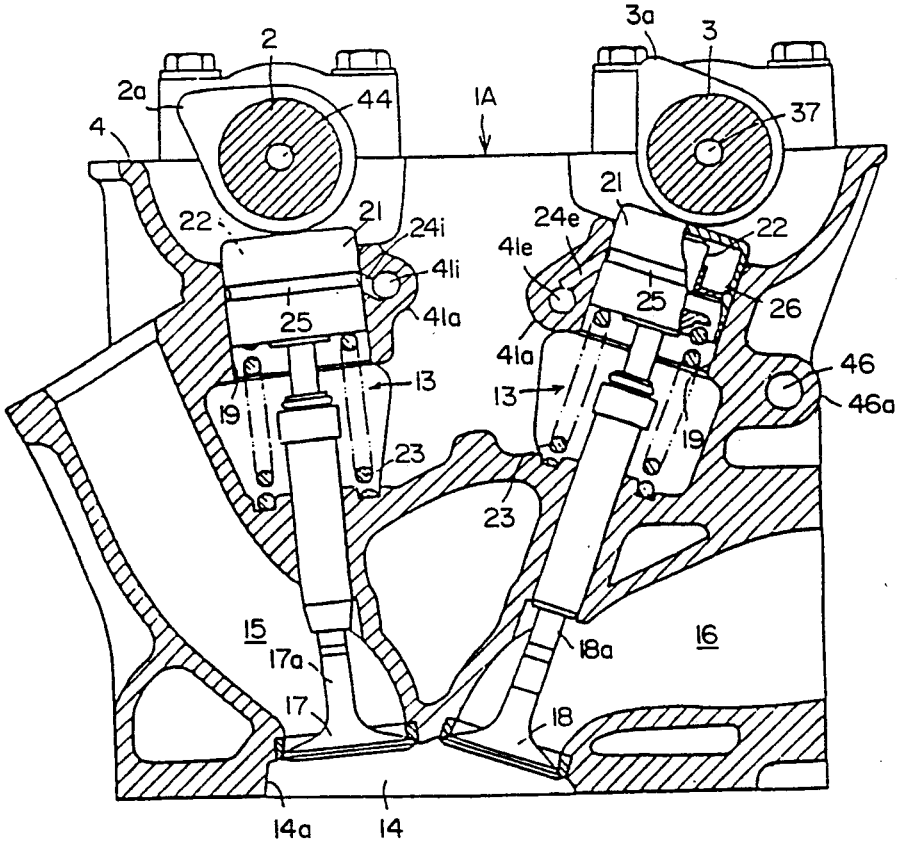
FIG. 5 is a cross-sectional view on line V—V of FIG. 1.

As shown in FIG. 5 in detail, the intake and exhaust valves 17 and 18 are each driven by a valve drive mechanism 13 with hydraulic valve lash adjusters 22, the same in structure and operation as each other, and which are located between the intake and exhaust cams **2*a* and valve stems 17*a* and 18*a* of the intake and exhaust valves 17 and 18** to automatically control the valve clearance.

Figure 6:
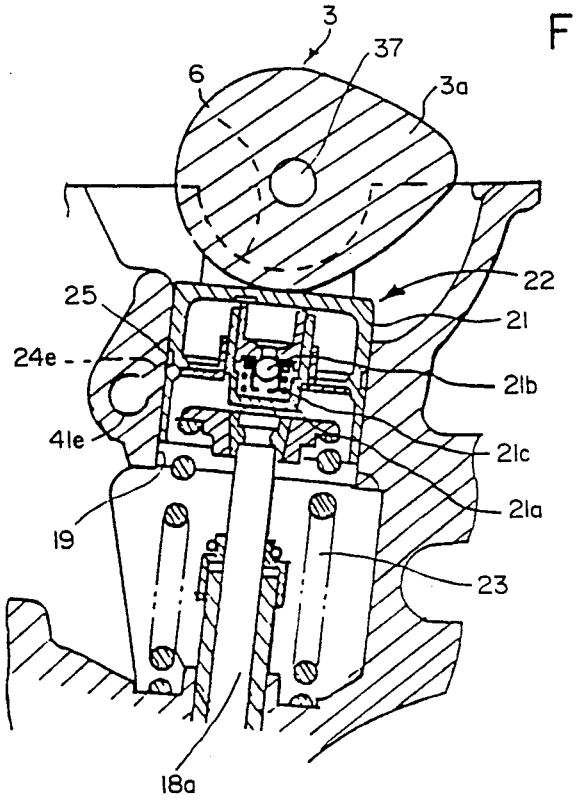
FIG. 6 is an enlarged cross-sectional view of a hydraulic valve lash adjuster.

The hydraulic valve lash adjuster 22, is well known in structure and operation in the art and is show in detail in FIG. 6. The lash adjuster comprises a bucket type, cylindrical tappet 21 snugly installed in a cylindrical tappet bore 19 formed in the cylinder head 4. A cylindrical plunger **21*a* is disposed within the tappet 21 with its lower end placed in contact with the head of the valve stem 17***a* or 18*a* of the intake valve 17 or the exhaust valve 18. Oil is passed to a high pressure chamber within the plunger 21*a* via a valve, such as a check ball 21*b*. A torsion spring 23 is disposed in the tappet bore 19 so as to force the tappet 21 upward. Further, a smaller torsion spring 21*c* is installed in the high pressure chamber to force the check ball 21*b* open, during opening the intake or exhaust, so as to allow the oil to flow out of the high pressure chamber, and thereby to force the tappet 21 to be always in close contact with the cam 2*a* or 3*a*, i.e., to automatically regulate the valve clearance to zero.

The hydraulic valve lash adjustor 22 is supplied with working oil delivered into the tappet bore 19 from a lubrication system described in detail later. The working oil flows into a peripheral groove 25 of the tappet 21 via an oil passage 24 and then, enters inside the tappet 21 through a hole or holes 26 formed in the peripheral groove 25. In this way, the working oil is supplied to the hydraulic valve lash adjuster 22. The working oil also enters between the tappet 21 and the tappet bore 19, so as to lubricate the tappet 21.

Figure 4:
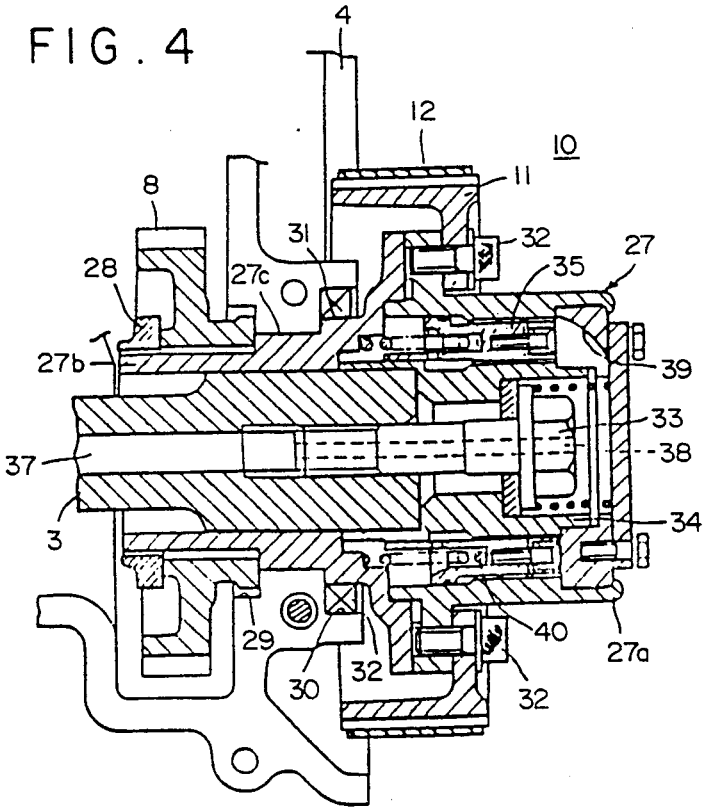
FIG. 4 is a cross-sectional view of a variable valve timing mechanism.

The variable valve timing mechanism 10, as shown in FIGS. 1 and 4, includes a cylindrical casing 27 mounted on the exhaust camshaft 3 for rotation, consisting of front and rear casing sections 27*a* and 27*b*. The mechanism 10 is coaxially secured to the outer end of the exhaust camshaft 3 through the rear casing section 27*b* and holds the drive pulley 11, fixed to the outer surface of the front casing section 27*a* by bolts 32. The camshaft gear 8 of the exhaust camshaft 3 in the gear chamber 9 is keyed to, and tightened by a nuts 28 against, the rear casing section 27*b*. The exhaust camshaft 3 is supported by the cam journal 6 through the rear casing section 27*b*. In detail, on the opposite sides of the journal bearing 6, there are formed circular shoulders 29 and 31 having diameters larger than that of the journal bearing 6. The camshaft gear 8 is forced against the shoulder 29 by the nut 28, and a circular shoulder 31 formed on a sleeve portion 27*c* of the rear casing section 27*b* is forced against the shoulder 30 due to pulling axially the rear casing section 27*b* by the nut 28. In this way, the exhaust camshaft 3 is exactly positioned in its axial direction. The casing 27 is sealed in an oil tight manner with a sealing ring 32.

A cylindrical spacer 34 is firmly secured, by a fixing bolt 33, to the end of the exhaust camshaft 3. In the front casing section 27*a* of the casing 27, a cylindrical slidable element, such as a hydraulic cylindrical piston 35, is installed in a space formed between the cylindrical casing 27 and the cylindrical spacer 34, and is fitted, or mounted on the cylindrical spacer 34. The piston 35 is formed on its inner and outer surfaces with internal and external helical splines cut in mutually opposite directions, respectively.

The cylindrical spacer 34 is formed on its outer surface with a helical spline which is in mesh with the internal helical spline of the piston 35. The front casing section 27*a* of the casing 27 is formed on its inner surface with a helical spline which is in mesh with the external helical spline of the piston 35. There is disposed in the casing 27 a compression coil spring 40 for urging the piston 35 forward.

Exhaust camshaft 3 is formed along its length with an axial oil passage 37 which is in communication with a through bore 38 formed in the fastening bolt 33. Facing the front end of the piston 35, the front casing section 27*a* of the casing 27 is formed with an oil chamber 39 into which a pneumatic pressure is developed by oil introduced thereinto through the axial oil passage 37 of the exhaust camshaft 4 and the through bore 38 of the fastening bolt 33.

Oil is introduced into the oil chamber 39 via the axial oil passage 37 and the axial bore 38. When the pneumatic pressure created in the oil chamber 39 rises sufficiently to pneumatically urge the piston 35 against the compression spring 40, the piston 35 is forced axially rearward. As the piston 35 moves axially, the cylindrical spacer 34 and the casing 27, which are operationally coupled to the piston 35 through their spline engagement, are forced to cause a relative rotational movement therebetween. As a result, the exhaust camshaft 3 integral with the cylindrical spacer 34 shifts its angular position relative to the drive pulley 11, so that the angular phase between the camshafts 2 and 3, i.e., the valve timing of the intake valve, is varied relatively to the valve timing of the exhaust valve.

On the other hand, when removing the pressure in the oil chamber 39, the piston 35 is forced by the spring 40 forwards, so as to cancel the angular phase difference between the camshafts 2 and 3.

The valve timing is changed in such a way to increase a valve overlap between the intake and exhaust valves 17 and 18 in a range of engine speeds of about 1500–2000 rpm so as to introduce the highly pressurized oil into the pressure chamber 39 and to decrease the valve overlap in a range of lower engine speeds.

Figure 7:
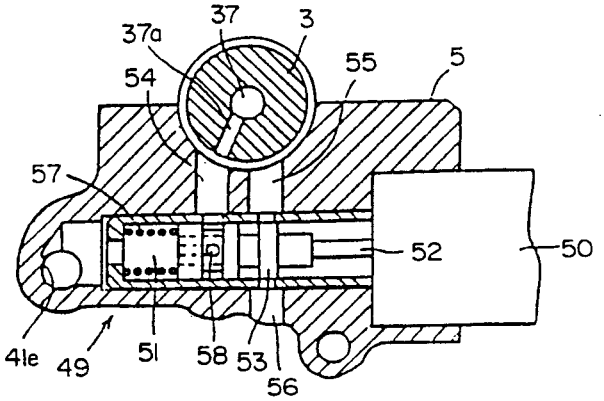
FIG. 7 is a cross-sectional view of a control valve shown in a state of oil supply.
Figure 8:
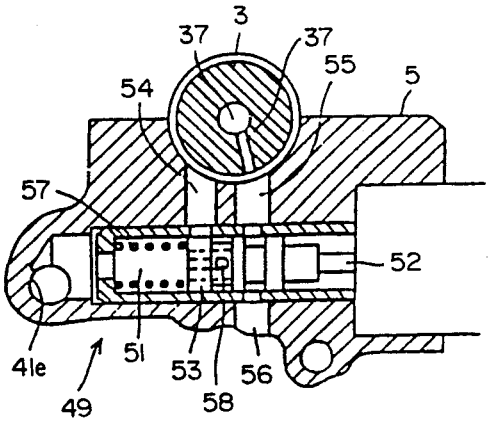
FIG. 8 is a cross-sectional view similar to FIG. 7 showing the control valve in a state of oil drain.

Distributing oil to the cam journal bearings 5 and 6, the variable valve timing mechanism 10 and the valve lash adjuster 22 is controlled by means of a hydraulic control system including oil passages shown in FIG. 1 and a control valve 49 shown in FIGS. 7 and 8.

The cylinder head 4 is formed with ribs 41*a*, (FIGS. 3 and 5) extending in parallel with each other in the lengthwise direction of the cylinder head 4 between the intake and exhaust camshafts 2 and 3, in which oil passages 41*i* and 41*e* are formed, respectively. These oil passages 41*i* and 41*e* are connected to the hydraulic valve lash adjustors 22 for the intake valves 17 and the exhaust valves 18 via the oil passages 24*i* and 24*e*, respectively, and are plugged at one end. The oil passage 41*i*, for the hydraulic valve lash adjustors 22 for the intake camshaft 2, is connected, at its rear end remote from the camshaft gear 7, to an axial oil passage 44 formed in the intake camshaft 2 via a communication passage 43 formed in a rearmost journal bearing 5 (See FIG. 1). The axial oil passage 44 is communicated with the journal bearings 5 via orifices 45 formed in the respective journal bearings 5. The oil passage 41*e*, for the hydraulic valve lash adjustors 22 for the exhaust camshaft 2, at its rear end remote from the camshaft gear 8, is connected, by a communication orifice 47, to an extra oil passage 46 formed in a rib 46*a* extending in parallel with the oil passage 41*e* in the lengthwise direction of the cylinder head 4 at one side of the cylinder head 4, opposite to the side where the rib 41*a* formed with the oil passage 41*e* is disposed, with respect to the valve lash adjustor 22 for the exhaust camshaft 3. The extra oil passage 46 is communicated with the journal bearings 6 via communication passages 48.

The oil passage 41*e* is also connected near the rear end to the axial oil passage 37 formed in the exhaust camshaft 3 via control valve means 49 which connects and disconnects the oil passage 41*e* and the axial oil passage 37.

As shown in FIGS. 7 and 8, the- control valve means 49 comprises a cylindrical valve chamber 51 in communication with the oil passage 41*e* and an oil supply outlet 54 and an oil drain inlet 55 opening into the rearmost journal bearing 6. A solenoid 50 has a plunger 52 with a cylindrical valve body 53 which can slide in the valve chamber 51 and is formed with a passage 58 in communication with the valve chamber 51. When the solenoid 50 is energized, the plunger 52 protrudes to slide the valve body 53 forward in the valve chamber 51 against the coil spring 57, so as to position an outlet of the passage 58 in alignment with the oil supply outlet 54. Accordingly, oil entering into the valve chamber 57 is forced into the axial oil passage 37 through a radial passage 37*a* formed in the exhaust camshaft 3. At this time, the oil drain inlet 55 and an oil drain outlet 56 are closed by the valve body 53. On the other hand, when the solenoid 50 is deenergized, the plunger 52 is retracted by the coil spring 57 to slide the valve body 53 backward in the valve chamber 51, so as then to position an outlet of the passage 58 out of the alignment with the oil drain inlet 54 and to communicate the oil drain inlet 55 with the oil drain outlet 56. As a result, the control valve 49 allows the oil in the axial oil passage 37 to be discharged through the oil drain inlet 55 and the oil drain outlet 56 via the radial passage 37*a*.

Figure 3:
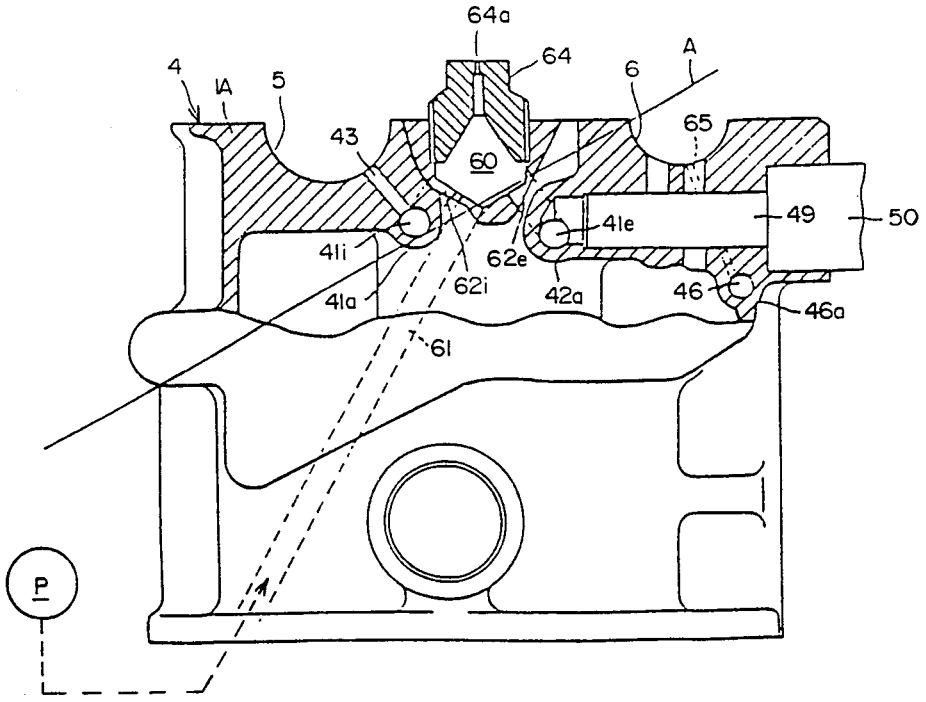
FIG. 3 is an end view, partly in cross-section along line III—III, of FIG. 1, wherein reference A shows a line parallel with a floor of a car body in which the engine is installed.

Distribution of oil into the oil passages 41*i* and 41*e* is performed by an oil pump P. As is shown in FIG. 3, the cylinder head 4 is formed with a vertically cylindrical oil gallery 60 in the top portion thereof between the oil passages 41*i* and 41*e*. The oil gallery 60, which is closed by a plug 64 with an air vent orifice 64*a*, is connected to the oil pump P through a mail oil passage 61, extending to the oil gallery 60 in a straight line substantially tangential to the oil gallery 60, and hence to the oil passages 41*i* and 41*e* through branch oil passages 62*i* and 62*e*, extending from the oil gallery 60 in straight lines substantially tangential to the oil gallery 60, respectively. The oil pump P pressurizes and pumps up oil into the oil gallery 60 via the mail oil passage 61 and then, into the oil passages 41*i* and 41*e* via the branch oil passages 62*i* and 62*e*. The oil, entering into and discharged from the oil gallery 60, produces swirls in the oil gallery 60, so as to discharge air out of the oil. The air is discharged through the air vent orifice 64*a*.

In general, because the exhaust camshaft 3 is attached, at its end portion, with the drive pulley 11 coupled to the crankshaft pulley by the timing belt 12, the exhaust camshaft 3 is imparted on the end portion with a large force in excess in the down direction from the tension of the timing belt 12. This downward force on the exhaust camshaft 3 makes it difficult for the foremost journal bearing 6 bearing the end portion of the exhaust camshaft 3 to be well lubricated. In order to lubricate the foremost journal bearing 6 well, the cylinder block 4 is formed with an oil passage extension 65 extending from passage 46 (FIG. 2) so as to open into the foremost journal bearing 6. Through the oil passage extension 65, the oil is well delivered between the foremost journal bearing 6 and the rear casing section 27*b* of the casing 27.

According to the oil distribution system, the oil pressurized and pumped by the oil pump P is at first forced into the oil gallery 60, and then to the respective valve lash adjustors 22 for the intake camshaft 2 via the branch oil passage 62*i* and then the oil passage 41*i* and also to the respective valve lash adjustors 22 for the exhaust camshaft 2 via the branch oil passage 62*e*, the oil passage 41*e* and then the extra oil passage 46. The oil in the oil passage 41*i* partly enters into the axial oil passage 44 of the intake camshaft 2 via the communication passage 43 and is delivered to the respective journal bearing 5 through the orifices 45 for lubrication.

The oil in the oil passage 41*e* is partly delivered to the control valve 49 and transmitted into the axial oil passage 37 of the camshaft 3 while the solenoid 50 is energized for actuating the variable valve timing mechanism 10. The oil in the oil passage 41*e* is also partly delivered into the orifice 47 to increase in pressure and then into the extra oil passage 46. During flow through the extra oil passage 46, the oil is distributed to the journal bearings 6 for the exhaust camshaft 3 for lubrication.

The cylinder head according to the preferred embodiment of the present invention described above directly distributes the oil maintained at a high pressure into the oil passages 41*i* and 41*e*, and also to the control valve 49, so that the valve lash adjustors 22 and the variable valve timing mechanism 10 can be operated, by the high pressure oil, with high efficiency and stability in operation.

The ribs 41*a* and 46*a* themselves, and the combination of the ribs 41*a* and 46*a* which cooperate with the journal bearings 6 for the exhaust camshaft 3 to form a truss structure, improve the cylinder head in rigidity.

Figure 9:
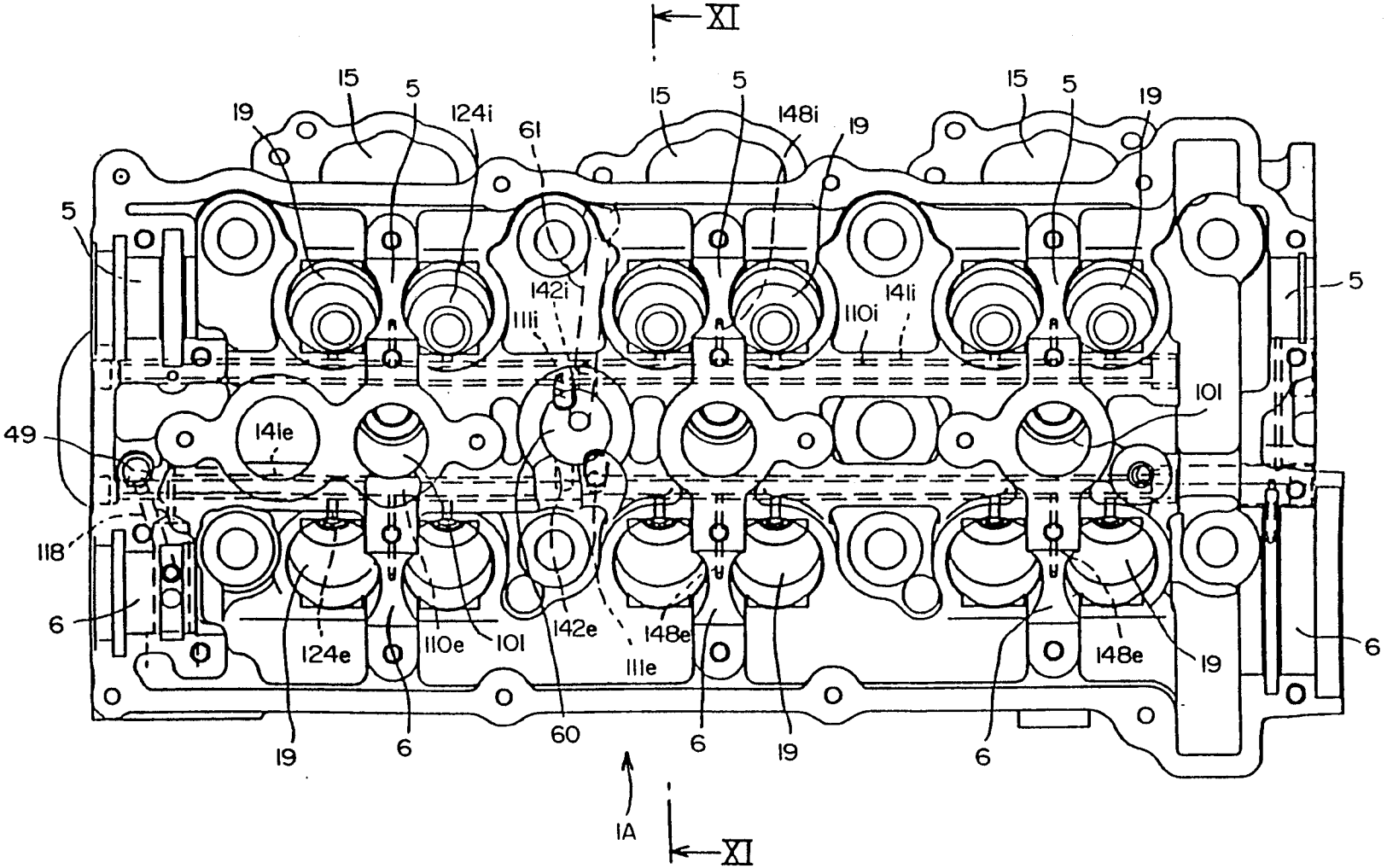
FIG. 9 is a plan view of a cylinder head of a double overhead camshaft engine having a lubrication system in accordance with another preferred embodiment of the present invention.
Figure 10:
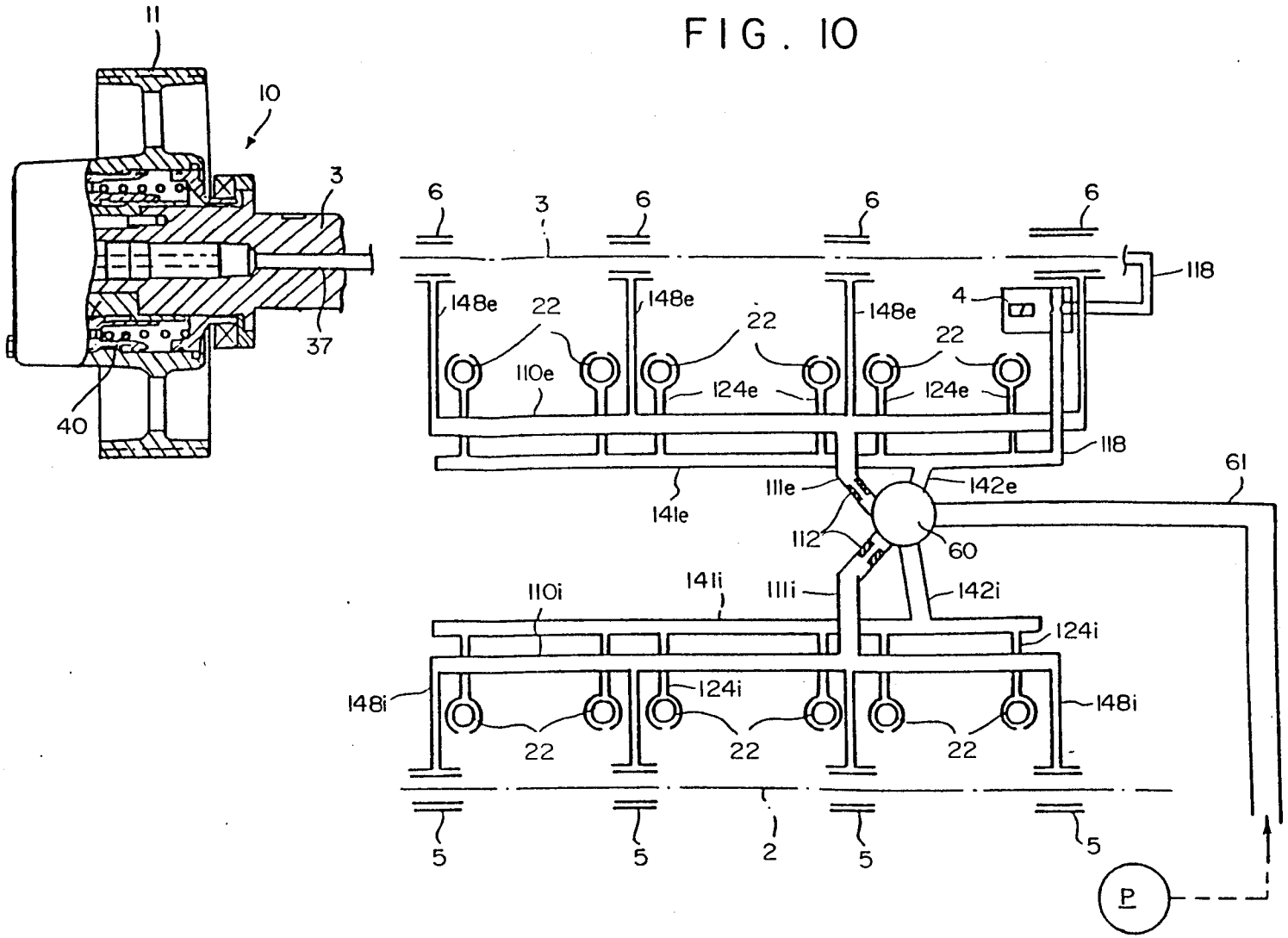
FIG. 10 is a diagrammatical view showing an arrangement of oil passages.
Figure 11:
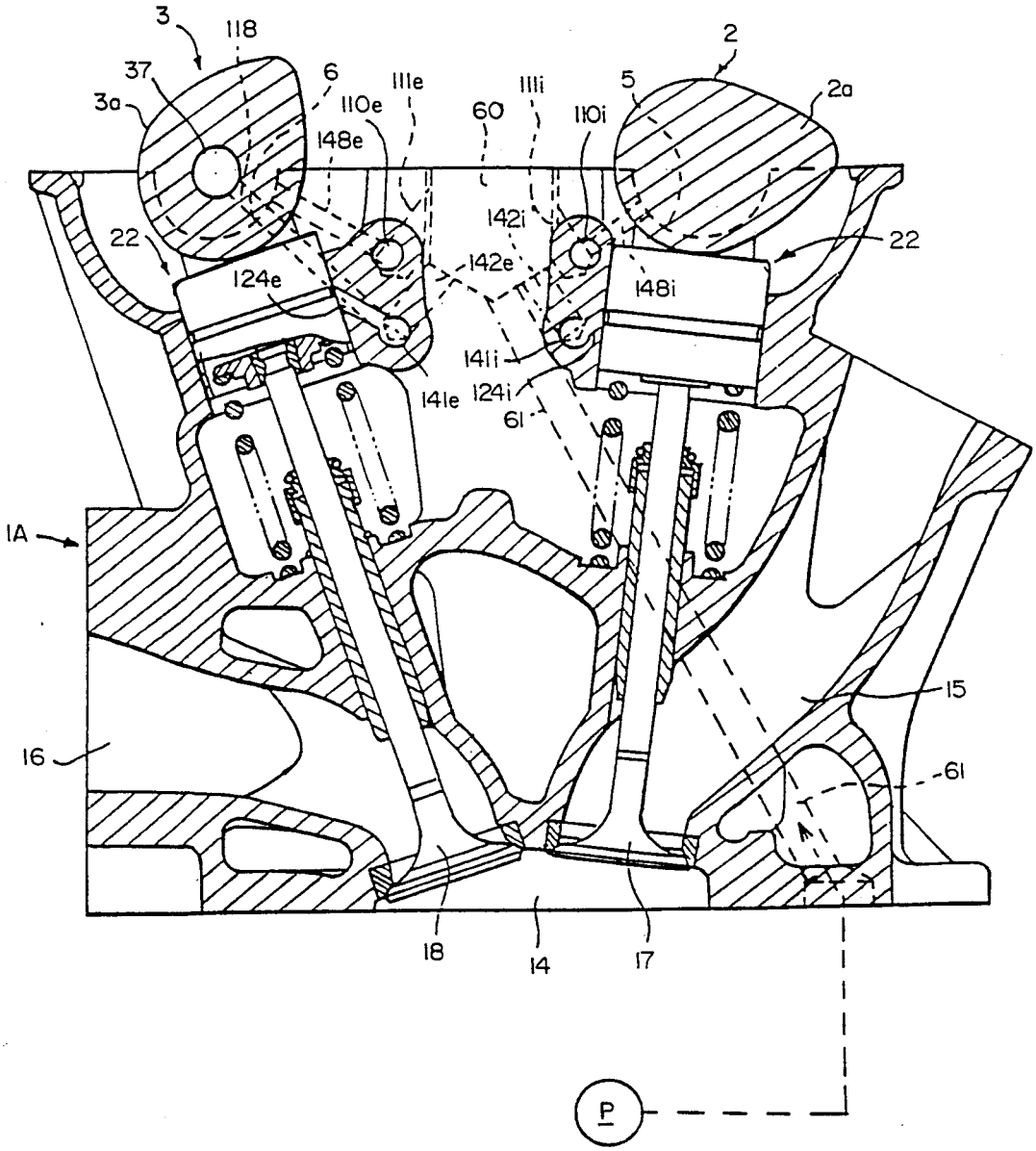
FIG. 11 is a cross-sectional view, on line XI—XI of FIG. 9.

Referring to FIGS. 9 to 11 showing a cylinder block for a V-type engine in accordance with another preferred embodiment of the present invention, distributing oil to the cam journal bearings 5 and 6, the variable valve timing mechanism 10 and the lash valve adjuster 22 is controlled by means of a hydraulic control system comprising a vertically cylindrical oil gallery 60 connected to a mail oil passage 61 through which hydraulic oil circulates pressurized by oil pump P installed in the cylinder block. An oil passage 141*i*, for the hydraulic valve lash adjusters 22 for the intake camshaft 2, is connected, at its mid portion, to the oil gallery 60 via a communication passage 142*i* provided with pressure regulating means, such as an orifice 139. An oil passage 141*e*, for the hydraulic valve lash adjustors 22 for the exhaust camshaft 2 is connected, at its mid portion, to the oil gallery 60 via a communication passage 142*e*. A plug hole 101 is formed in the upper portion of the cylinder head 4, approximately centrally corresponding to each cylinder.

The oil is introduced into the cylinder head 4 by the oil pump P through the main oil passage 61 extending obliquely from an approximately central lower end portion of the cylinder head 4 toward the upper central portion. The main oil passage 61 is in communication with an oil gallery 60 formed in the upper portion of the cylinder head 4.

Along the lengthwise direction of the cylinder head 4 there are oil passages 110*i* and 110*e*, which are arranged in parallel with each other between the camshafts 2 and 3 and on both sides of the oil gallery 60, for supplying oil to journal bearings 5 and 6, and oil passages 141*i* and 141*e* which are located below the oil passages 110*i* and 110*e*, respectively and arranged in parallel with each other between the camshafts 2 and 3 and on both sides of the oil gallery 60, for supplying oil to the hydraulic valve lash adjuster 22. The oil passages 110*i* or 110*e* are connected to the oil gallery 60 via connecting passages 111*i* and 111*e* with pressure regulating means, such as orifices 112. The oil passages 141*i* and 141*e* are connected to the oil gallery 60 via connecting passages 142*i* and 142*e*, respectively. Oil passages 124*i* and 124*e*, short in length, respectively, communicate the oil passages 141*i* and 141*e* with the tappet bores 19 so as to supply high pressure oil to the hydraulic valve lash adjusters 22 in the tappet bores 19.

Control valve 49 is installed in the end portion of the cylinder head 4 close to the rearmost journal bearing 6 for the exhaust camshaft. The oil passage 141*e* is connected at the rear end to the axial oil passage 37 in the exhaust camshaft 3 by an oil passage extension 118 provided with the control valve 49 which connects and disconnects the oil passage 141*e* and the axial oil passage 37. Thus, the oil is supplied, via the axial oil passage 37 of the exhaust camshaft 3, to the variable valve timing mechanism 10 arranged at the end of the exhaust camshaft 3.

According to the engine lubrication system of the cylinder head 4 of the invention described above, it is not necessary to supply high pressure oil to the journal bearings 5 and 6 supporting, respectively, the intake camshaft 2 and the exhaust camshaft 3. By supplying a low pressure oil from the oil gallery 60 regulated by the orifices 112 through the oil passages 110*i* and 110*e*, the quantity of end flow oil is reduced, so as thereby to raise the pressure of oil delivered to the other oil passages, namely the oil passages 141*i* and 141*e*. Furthermore, because the variable valve timing mechanism 10 and the hydraulic valve lash adjusters 22, which are inherently necessary to be supplied with high pressure oil, can be supplied with high pressure oil, without using an increased capacity of oil pump, both the variable valve timing mechanism 10 and the hydraulic valve lash adjusters 22 perform their operations favorably.

Although the oil pump P operates at low speeds and generates insufficient oil pressure while the engine operates at lower speeds, by causing the control valve 49 to close the oil passage extension 118, in communication with the variable valve timing mechanism 10, so as to deliver a concentrated, high pressure of oil to the hydraulic valve lash adjuster 12 even at lower engine speeds, an accurate operation of the hydraulic valve lash adjusters 22 is ensured.

The engine lubrication system described above provides a reduction in quantity of end flow oil by supplying low pressure oil to the journal bearings for camshafts through the journal bearing oil passage from the main oil passage via the pressure regulating means. Furthermore, The engine lubrication system supplies a high oil pressure to both the variable valve timing mechanisms and the hydraulic valve lash adjusters without using a large capacity of oil pump, so as to allow them to operate without generating anomalous sounds due to discharge of air in the hydraulic valve lash adjusters at an early stage of operation.

It is to be understood that whereas the invention has been described in detail with respect to preferred embodiments, thereof, nevertheless, various other embodiments and variants are possible which are within the spirit and scope of the invention, and such other embodiments and variants are intended to be covered by the following claims.

What is claimed is:

1. A lubrication system for a double overhead camshaft engine having a cylinder head equipped with a hydraulic variable valve timing mechanism coupled to one of an intake and an exhaust overhead camshaft, the camshafts arranged in parallel to each other with respect to a crankshaft of the engine and supported, respectively, by bearing means for rotation and a hydraulic valve lash adjuster installed in the cylinder head for each valve, said lubrication system comprising:

a lubrication oil passage formed in said cylinder head for supplying pressurized oil to said bearing means for lubrication;

pressure regulating means disposed in said lubrication oil passage for providing a decrease in pressure of said pressurized oil;

a first oil supply passage formed in said cylinder head branching off from said lubrication oil passage ahead of said pressure regulating means for supplying pressurized oil to and lubricating said hydraulic valve lash adjusters;

a second oil supply passage formed in said cylinder head extending from said first oil supply passage for supplying said pressurized oil to and actuating said hydraulic variable valve timing mechanism; and control valve means disposed in said second oil supply passage for selectively opening said second oil supply passage to actuate said hydraulic variable valve timing mechanism with said pressurized oil.

2. A lubrication system as defined in claim 1, and further comprising an oil passage formed in said one overhead camshaft along its entire axial length for interconnecting said second oil supply passage and said hydraulic valve lash adjuster.

3. A lubrication system as defined in claim 2, wherein said lubrication oil passage and first oil supply passage comprise, respectively, bores which extend along substantially the entire length of said cylinder head and are arranged one above the other in a vertical plane between said intake and exhaust overhead camshafts.

4. A lubrication system as defined in claim 2, wherein said control valve means operates to close said second oil supply passage when the engine operates at lower speeds.

5. A lubrication system as defined in claim 1, wherein said pressure regulating means comprises an orifice disposed in said lubrication oil passage.

6. A lubrication system as defined in claim 1, wherein said control valve means comprises an electrically controlled solenoid valve.

7. A lubrication system for a double overhead camshaft engine having a cylinder head equipped with intake and exhaust overhead camshafts, a hydraulic variable valve timing mechanism coupled to an end of one of said intake and exhaust overhead camshafts, which is operationally coupled to a crankshaft of the engine, and a hydraulic valve lash adjuster installed in the cylinder head for each valve of the engine, said intake and exhaust overhead camshafts being operationally coupled to each other, arranged in parallel to each other with respect to the crankshaft of the engine and supported separately by bearing means for rotation, said lubrication system comprising:

a first oil passage formed, for each of said intake and exhaust overhead camshafts, in said cylinder head between said intake and exhaust overhead camshafts and in parallel with said crankshaft for supplying pressurized oil to and actuating said hydraulic valve lash adjusters;

a second oil passage formed in said cylinder head on a side of said one overhead camshaft opposite to a side where said first oil passage is formed and communicating with said first oil passage for said one overhead camshaft for supplying pressurized oil to said bearing means of said one overhead camshaft for lubrication;

third oil passages formed in each of said intake and exhaust overhead camshafts respectively and in communication with said first oil passage, said third oil passage for said one overhead camshaft being connected to said hydraulic variable valve timing mechanism for supplying said pressurized oil to and actuating said hydraulic variable valve timing mechanism, and said third oil passage for the other overhead camshaft being communicated with said bearing means for the other overhead camshaft so as to supply said pressurized oil to said bearing means for the other overhead camshaft for lubrication; and a control valve means disposed between said first and second oil passages for said one overhead camshaft for opening said second oil passage for said one overhead camshaft so as to supply said pressurized oil to and actuate said hydraulic variable valve timing mechanism.

8. A lubrication system as defined in claim 7, wherein said first oil passages for said intake and exhaust overhead camshafts are arranged in parallel with each other.

9. A lubrication system as defined in claim 7, wherein said control valve means comprises an electrically controlled solenoid valve.

* * * * *